United States Patent [19]

Torii

[11] Patent Number: 4,995,653

[45] Date of Patent: Feb. 26, 1991

[54] DOOR LOCK APPARATUS

[75] Inventor: Nozomu Torii, Hekinan, Japan

[73] Assignees: Aisin Seiki Kabushiki Kaisha; Aisin Hoyo Kabushiki Kaisha, both of Aichi, Japan

[21] Appl. No.: 497,189

[22] Filed: Mar. 22, 1990

[30] Foreign Application Priority Data

Mar. 24, 1989 [JP] Japan ..... 1-33858

[51] Int. Cl.[5] ..... E05C 3/26

[52] U.S. Cl. ..... 292/216

[58] Field of Search ..... 292/216, 280, 336.3, 292/DIG. 26, DIG. 27

[56] References Cited

U.S. PATENT DOCUMENTS

| | | | |
|---|---|---|---|
| 4,073,519 | 2/1978 | Kurozu et al. | 292/216 |
| 4,334,704 | 6/1982 | Yamada | 292/216 |
| 4,492,395 | 1/1985 | Yamada et al. | 292/216 |

FOREIGN PATENT DOCUMENTS 58-23886 of 0000 Japan .

*Primary Examiner*—Richard E. Moore

*Attorney, Agent, or Firm*—Finnegan, Henderson, Farabow, Garrett and Dunner

[57] ABSTRACT

A door lock apparatus includes a latch pivotally supported on a base, a pawl pivotally supported on the base for engaging with the latch to limit its rotation, an opening lever pivotally supported on the base by the same rotary shaft as that of the pawl for being rotated to rotate the pawl, thereby disengaging the latch and the pawl, a release bush slidably pivoted on the pawl for engaging with the opening lever to transmit the rotating motion of the opening lever to the pawl, and a locking lever pivotally supported on the base for being rotated to slide the release bush, thereby disengaging the release bush and the opening lever. The locking lever is formed to have an oblong hole engaged by the release bush to transmit turning motion of the locking lever to the release bush. The oblong hole defines a circular arc whose center is the rotary shaft of the opening lever and pawl.

2 Claims, 3 Drawing Sheets

DOOR LOCK APPARATUS

BACKGROUND OF THE INVENTION

This invention relates to a door lock apparatus for an automotive vehicle.

A known door lock apparatus for an automotive vehicle is as disclosed in the specification of Japanese Utility Model Application Laid-Open (KOKAI) No. 58-23886. This prior-art door lock apparatus comprises a base, a latch pivotally supported on the base, a ratchet pivotally supported on the base for engaging with the latch to limit the rotation thereof, an opening plate pivotally supported on the base by a rotary shaft the same a that of the ratchet for disengaging the latch and the ratchet, a locking lever rotatably pivoted on the base for disengaging the ratchet and the opening plate, and a connecting body pivotally supported on the locking lever via a vertically movable arm and passing through a window formed in the open plate so as to be capable of engaging with and disengaging from a contact edge formed on the ratchet. When the connecting body and the contact edge are in the engaged state, turning the opening plate causes the inner wall of the window to abut against and urge the connecting body so that it is turned about the portion connected to the locking lever. Owing to its turning motion, the connecting body abuts against and urges the contact edge to turn the ratchet. As a result, the latch and ratchet are disengaged so that a state is attained in which the latch is capable of being turned, i.e., in which the door can be opened. Turning the locking lever moves the connecting body up and down via the vertically movable rod to disengage the connecting body from the contact edge. Accordingly, the locked state is attained in which the door cannot be opened even if the opening plate is manipulated.

A problem encountered with the above-described door lock apparatus is that the centers of rotation of the ratchet and opening plate and the center of turning motion of the connecting body do not agree in the radial direction. As a result, when the opening plate is rotated, the connecting body urges the contact edge while sliding along it. This causes the contact edge to sustain an abnormal amount of wear and to develop a roughened surface. The surface roughness of the contact edge produces an unpleasant sensation when the door lock is operated.

SUMMARY OF THE INVENTION

Accordingly, an object of the present invention is to provide a door lock apparatus in which sliding contact between the opening plate and contact edge is prevented.

According to the present invention, the foregoing object is attained by providing a door lock apparatus comprising a base, a latch pivotally supported on the base, a pawl pivotally supported by a rotary shaft on the base for engaging with the latch to limit the rotation thereof, an opening lever pivotally supported on the base by the rotary shaft of the pawl for being rotated to rotate the pawl, thereby disengaging the latch and the pawl, a release bush slidably pivoted on the pawl for engaging with the opening lever to transmit the rotating motion of the opening lever to the pawl, and a locking lever pivotally supported on the base for being rotated to slide the release bush, thereby disengaging the release bush and the opening lever, the locking lever being formed to have an oblong hole for being engaged by the release bush to transmit turning motion of the locking lever to the release bush, the oblong hole defining a circular arc whose center is the rotary shaft of the opening lever and pawl.

In operation, rotating the opening lever causes it to abut against and urge the release bush, which is thus caused to turn while traveling along the oblong hole. Owing to this turning motion of the release bush, the pawl turns so that the latch and the pawl are disengaged. In other words, a state is established in which the door can be opened. Since the release bush thus turns along the oblong hole, the center of this turning motion is identical with the turning centers of the pawl and opening lever. As a result, sliding contact between the pawl and the release bush can be prevented. This makes it possible to prevent abnormal wear of the portion of contact between the pawl and release bush and to improve the operating sensation of the apparatus.

Other features and advantages of the present invention will be apparent from the following description taken in conjunction with the accompanying drawings, in which like reference characters designate the same or similar parts throughout the figures thereof.

DESCRIPTION OF THE PREFERRED EMBODIMENT

Figure 1:
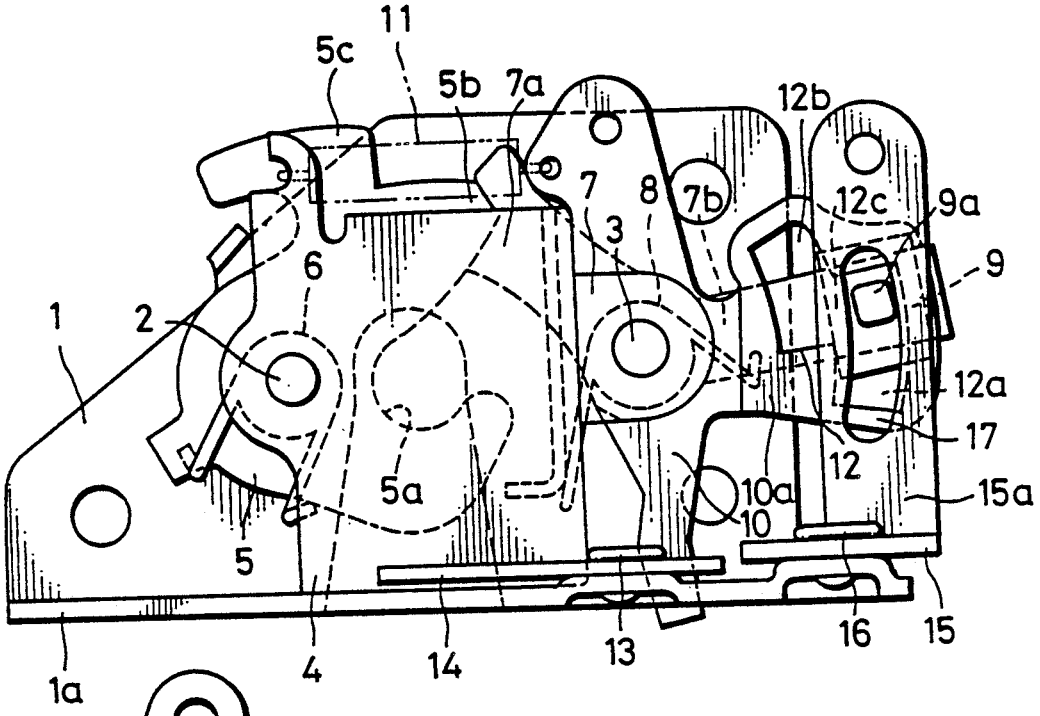
FIG. 1 is a plan view showing an embodiment of a door lock apparatus according to the present invention and illustrating the apparatus in a condition in which the door closed in the unlocked state.

An embodiment of the present invention will now be described in detail with reference to the accompanying drawings.

As shown in FIGS. 1 through 5, a bracket 4 is secured via pins 2, 3 to a base 1 fixedly secured to the body (not shown) of an automotive vehicle. A latch 5 is pivotally supported between the base 1 and the bracket 4 by the pin 2. The latch 5 is biased in the clockwise direction in FIG. 1 at all times by a spring 6 wound on the pin 2 and having its one end fastened to the bracket 4 and its other end fastened to the latch 5. The latch 5 is formed to have an engaging portion 5*a* that engages with a striker (not shown) secured to a door (not shown). The peripheral surface of the latch 5 is formed to have two locking portions 5*b*, 5*c*. A pawl 7 is pivotally supported by the pin 3 between the base 1 and the bracket 4. The pawl 7 is biased in the counter-clockwise direction in FIG. 1 at all times by a spring 8 wound on the pin 3 and having its one end fastened to the bracket 4 and its other end fastened to the pawl 7. The pawl 7 is formed to have a mating member 7*a*, which is capable of mating with the locking portions 5*b*, 5*c* to limit rotation of the latch 5. The door is held in the completely closed position by mating the mating member 7*a* with the locking portion 5b, and in the half-closed position by mating the mating member 7a with the locking portion 5c. The pawl 7 is further formed to have an arm portion 7b. A release bush 9 is slidably retained on the arm 7b.

An opening lever 10 is pivotally supported by a pin 3 between the base 1 and the bracket 4. The opening lever 10 is biased in the counter-clockwise direction in FIG. 2 at all times by a spring 11 having its one end fastened to the bracket 4 and its other end fastened to one end of the opening lever 10. The latter is formed to include an arm portion 10a having an oblong hole 12. A shaft portion 9a formed on the release bush 9 is passed through the oblong hole 12 to mate therewith. The oblong hole 12 has a crank-shaped configuration and is constituted by arcuate first and second holes 12a and 12b, respectively, each having the pin 3 as its center, and a third hole 12c connecting the first hole 12a and the second hole 12b. In the state shown in FIG. 1, the shaft portion 9a is situated on the second hole 12a-side of the third hole 12c. Connected to one end of the opening lever 10 is an outside handle (not shown) serving as means for opening the door from outside of the vehicle. Engaged with the other end of the opening lever 10 is an L-shaped inside lever 14 pivotally supported by a pin 13 on an upstanding wall 1a of the base 1. An inside handle (not shown) serving as means for opening the door from inside the vehicle is connected to the inside lever 14.

A locking lever 15 is pivotally supported by a pin 16 on the upstanding wall la of the base 1. A locking knob (not shown) serving as means for locking the door from inside the vehicle is connected to the locking lever 15. The latter is formed to include an arm portion 15a orthogonal to the shaft portion 9a, and the arm portion 15a is formed to include an arcuate oblong hole 17. The oblong hole 17 defines a circular arc whose center is the pin 3. The shaft portion 9a is engaged with the oblong hole 17 and, in the state illustrated in FIG. 1, is situated at one end of the oblong hole 17. A turnover spring 18 is disposed between the locking lever 15 and the upstanding wall 1a of the base 1. Two positions, namely a locking position and an unlocking position of the locking lever 15 is set by the turnover spring 18, and the spring 18 holds the locking lever 15 at these two positions.

The operation of the apparatus will now be described.

FIGS. 1 through 4 illustrate a state in which the door is held completely closed, wherein the striker (not shown) is engaged with the engaging portion 5a of the latch 5 and the mating portion 7a of the pawl 7 is mating with the locking portion 5b of the latch 5.

Figure 2:
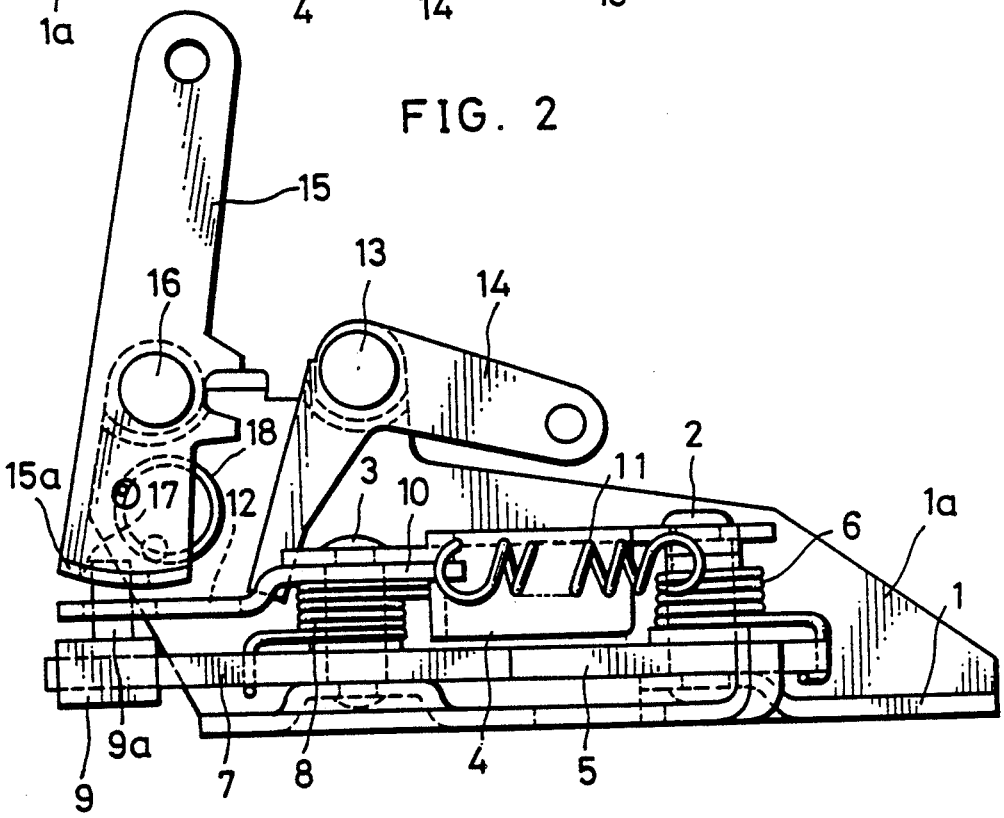
FIG. 2 is a side view of the apparatus in the state shown in FIG. 1.
Figure 5:
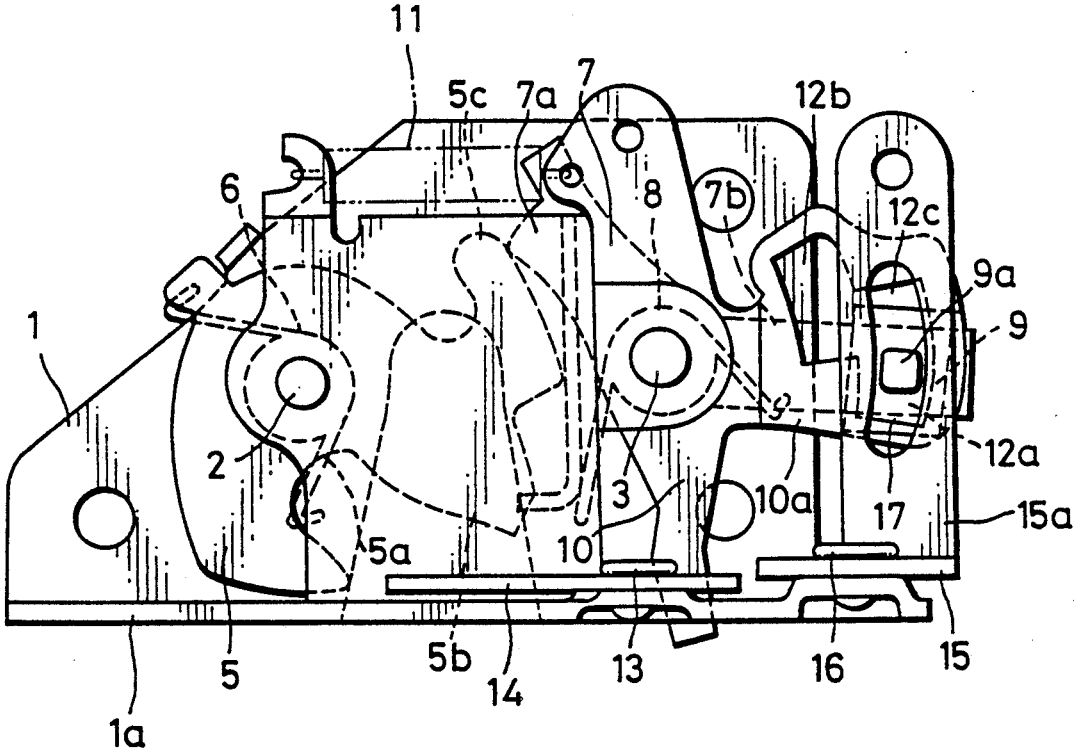
FIG. 5 is a plan view of the apparatus of FIG. 1 illustrating the apparatus in a condition in which the door is open.

In the state depicted in FIGS. 1 and 2, when the inside handle or outside handle is operated to rotate the opening lever 10 clockwise in FIG. 1 against the biasing force of the spring 11, the side wall of the third hold 12c abuts against and urges the shaft portion 9a, which is situated on the first hole 12a-side of the third hole 12c, thereby turning the release bush 19 clockwise in FIG. 1 along the oblong hole 17. Accordingly, the pawl 7 is turned clockwise in FIG. 1 to disengage the mating portion 7a and the locking portion 5b. As a result, the latch 5 assumes a state in which it can be rotated. In other words, a state is established in which the door can be opened. By performing a door-opening operation, and by virtue of the biasing force of the spring 6, a state is attained in which the door is open, as shown in FIG. 5. In the state illustrated in FIG. 5, the mating portion 7a and the side face of the locking portion 5c are in abutting contact and the pawl 7 is held at a non-engaging portion (i.e., the shaft portion 9a is held at the position of the first hole 12a ) against the biasing force of the spring 8. Only the opening lever 10 is returned to the state of FIGS. 1 and 2 by the biasing force of the spring 11. Thus, since both the release bush 9 and the pawl 7 turn about the pin 3, the pawl 7 and the release bush 9 do not come into sliding contact, as a result of which abnormal wear of abutting portions of the pawl 7 and release bush 9 can be prevented. In addition, the sensation experienced when the inside handle or outside handle is operated can be improved.

Figure 3:
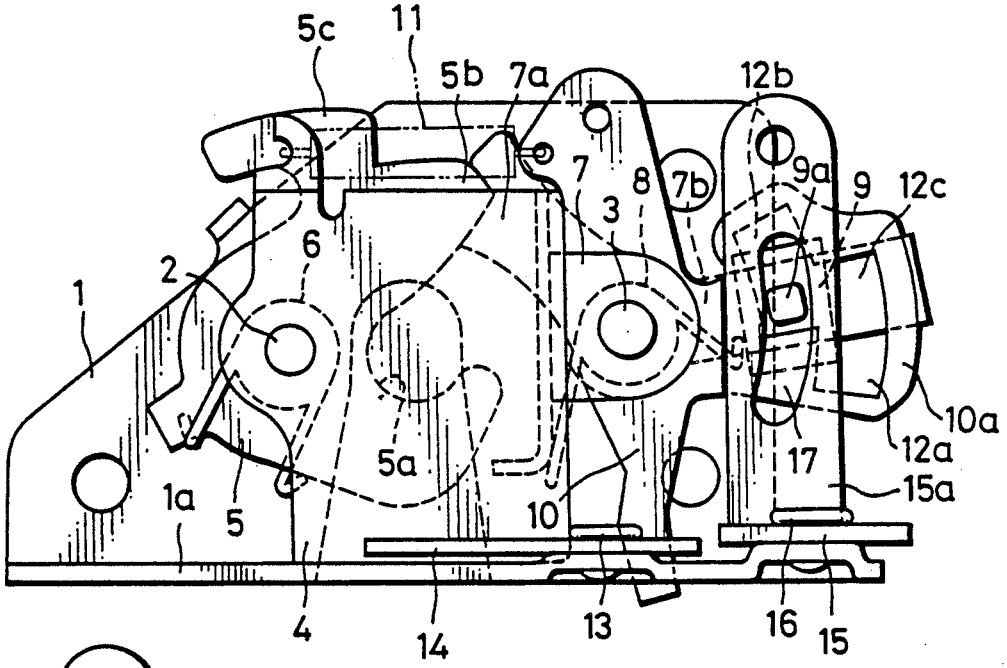
FIG. 3 is a plan view of the door lock apparatus illustrating the apparatus in a condition in which the door is closed in the locked state.
Figure 4:
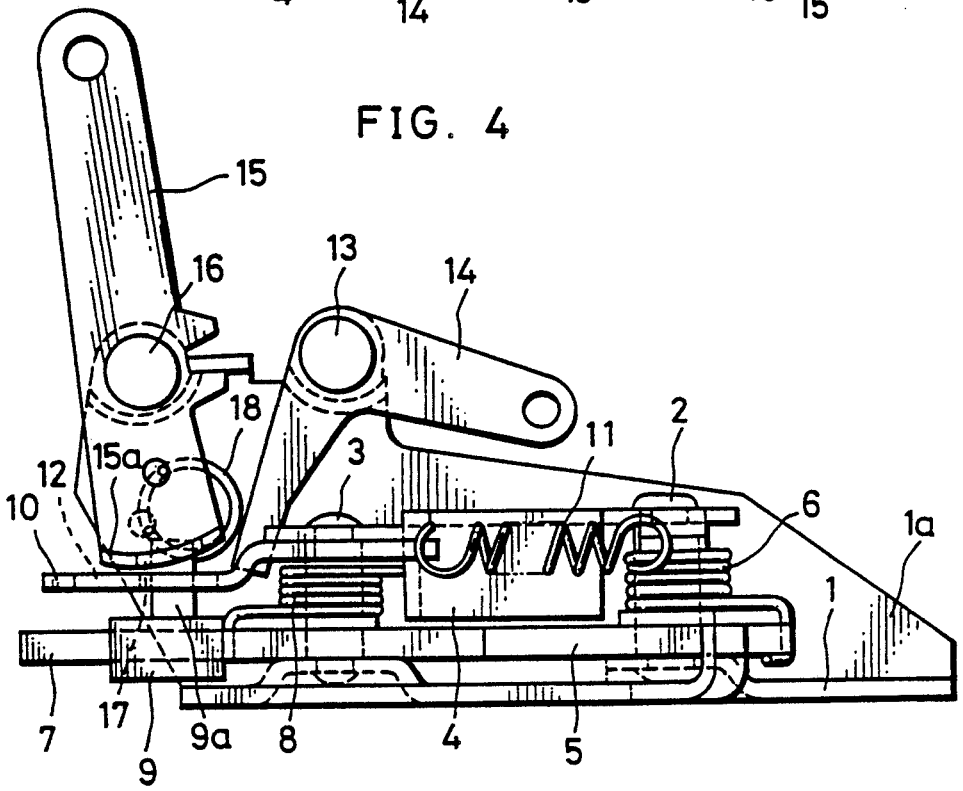
FIG. 4 is a side view of the apparatus in the state shown in FIG. 3.

When, in the state of FIGS. 1 and 2, the locking knob is manipulated to rotate the locking lever 15 counter-clockwise in FIG. 2, the side wall of the oblong hole 17 abuts against and urges the shaft portion 9a on the first hole 12a-side of the third hole 12c to slide the release bush 9 along the third hole 12c. As a result, the shaft portion 9a is shifted to the second hole 12b-side of the third hole 12c, as shown in FIGS. 3 and 4, to establish the door-locked state. In this state, even if the inside handle or outside handle is manipulated to turn the opening lever 10 clockwise in FIG. 1, the shaft portion 9a merely slides in the second hole 12b, and the side wall of the third hole 12 does not abut against and urge the shaft portion 9a to turn the pawl 7. The mating portion 7a and the locking portion 5b remain engaged and the door is maintained in the locked state.

When the locking knob is manipulated to rotate the locking lever 15 in the door-open state shown in FIG. 5, the shaft portion 9b and the side wall of the first hole 12a come into abutting contact and the unlocked state is maintained, namely the state in which the sliding of the release bush 9 is limited. Consequently, even if the locking knob is inadvertently manipulated while the door is in the open state, the locked state cannot be established. This prevents the driver from inadvertently locking the key in the driver compartment. When the outside handle is manipulated in the state of FIG. 5 to rotate the opening lever 10 clockwise in FIG. 5, the shaft portion 9a slides inside the first hole 12a and comes to be situated on the first hole 12a-side of the third hole 13c. If the locking knob is manipulated to rotate the locking lever 10 in this state, the shaft portion 9a abuts against and is urged by the side wall of the oblong hole 17, the release bush 9 slides and the shaft portion 9a is shifted to the second hole 12b-side of the third hole 12c, whereby the locked state is established. As a result, keyless locking can be achieved by manipulating the locking knob while manipulating the outside handle in the state where the door is open.

The present invention is advantageous in that sliding contact between the pawl and the release bush can be prevented. This makes it possible to prevent abnormal wear of the portions of contact between the pawl and release bush and to improve the operating sensation of the apparatus.

As many apparently widely different embodiments of the present invention can be made without departing from the spirit and scope thereof, it is to be understood that the invention is not limited to the specific embodiments thereof except as defined in the appended claims.

What is claimed is:

1. A door lock apparatus, comprising:

a base;

a latch pivotally mounted on said base;

a pawl pivotally supported on a pivot shaft, said pivot shaft being mounted to said base; said pawl being engageable with said latch for limiting rotation of the latch;

a release bush slidably mounted on said pawl, said release bush having a projection;

an opening lever pivotally mounted on said pivot shaft, said opening lever having an elongate slot for receiving the projection of the release bush to transmit rotating motion of said opening lever to said pawl for rotating the pawl out of engagement with said latch; and a locking lever, having an arcuate opening with a radius or the arc aligned with said pivot shaft, said release bush projection extending into said arcuate opening for transmitting a turning motion of said locking lever to said release bush, said release bush being slidable upon rotation of said locking lever for disengaging said release bush from said opening lever.

2. A door lock apparatus according to claim 1 wherein said elongate slot of said opening lever includes a first arcuate portion having a radius aligned with the pivot shaft, and having a second portion within the first portion, said projection of said release bush being located in said second portion when said locking lever is rotated.

* * * * *